US006167907B1

(12) United States Patent
Liaw

(10) Patent No.: US 6,167,907 B1
(45) Date of Patent: Jan. 2, 2001

(54) POWER TRANSFER PUMP

(76) Inventor: Bo-Lin Liaw, No. 128, Chung-Mei St., West Dis. Taichung (TW)

( * ) Notice: Under 35 U.S.C. 154(b), the term of this patent shall be extended for 0 days.

(21) Appl. No.: 09/296,657

(22) Filed: Apr. 23, 1999

(51) Int. Cl.[7] ..... F04B 17/00; F16N 33/00

(52) U.S. Cl. ..... 137/565.17; 184/1.5; 417/360; 417/410.4; 418/166

(58) Field of Search ..... 137/565.17, 899; 417/360, 405, 410.4; 418/166, 171; 184/1.5

(56) References Cited

U.S. PATENT DOCUMENTS 2,428,181 * 9/1947 Sibley ..... 418/166
2,477,450 * 7/1949 Gray ..... 184/1.5
4,718,827 * 1/1988 Sutton et al. ..... 417/360
5,165,867 * 11/1992 Dockery ..... 417/360
5,425,625 * 6/1995 Hsu ..... 417/410.4

FOREIGN PATENT DOCUMENTS

593732 * 3/1960 (CA) ..... 417/410.4

* cited by examiner

*Primary Examiner*—John J. Vrablik
(74) *Attorney, Agent, or Firm*—Bacon & Thomas PLLC

(57) ABSTRACT

A power transfer pump includes a rotary pump disposed within connected body sections comprising a top body, a main body with two ports and a cylindrical chamber to house a rotary assembly, a supporting body fitted with a connecting head, and a mounting body. The mounting body has a flexible ring, a bolt and forms a drive motor chamber with the supporting body to receive and clamp a power source that engages with the rotary assembly to activate the pump. The power transfer pump integrates into an oil removal station whereby by means of the rotary pump assembly, an oil sucking and discharging effect is created.

2 Claims, 9 Drawing Sheets

POWER TRANSFER PUMP

FIELD OF THE INVENTION

The present invention relates to a pump structure improvement, and more particularly to a power transfer pump.

BACKGROUND OF THE INVENTION

A conventional transfer pump is typically fitted with a mechanical or pressurized fluid drive device that produces power to drive a liquid or gas to a certain position. Attachment of the drive device to the conventional pump may cause design difficulties due to troublesome pump and drive device configuration arrangements.

SUMMARY OF THE INVENTION

The principal objective of the present invention is to provide a rotary transfer pump that is easily connected to a power source. In order to eliminate some of the disadvantages and limitations of a conventional pump, a power transfer pump is fitted with several body sections. The pump has a top body attached to one end of a main body and a supporting body fitted with a mounting body attached to another end of the main body such that the whole body is easily assembled or disassembled. The power transfer pump configuration permits easy connection to a power source, such as an interchangeable pneumatic or electric tool, that can be used to rotate a rotary assembly disposed within the body sections. L

DETAILED DESCRIPTION OF THE PREFERRED EMBODIMENT

Figure 1:
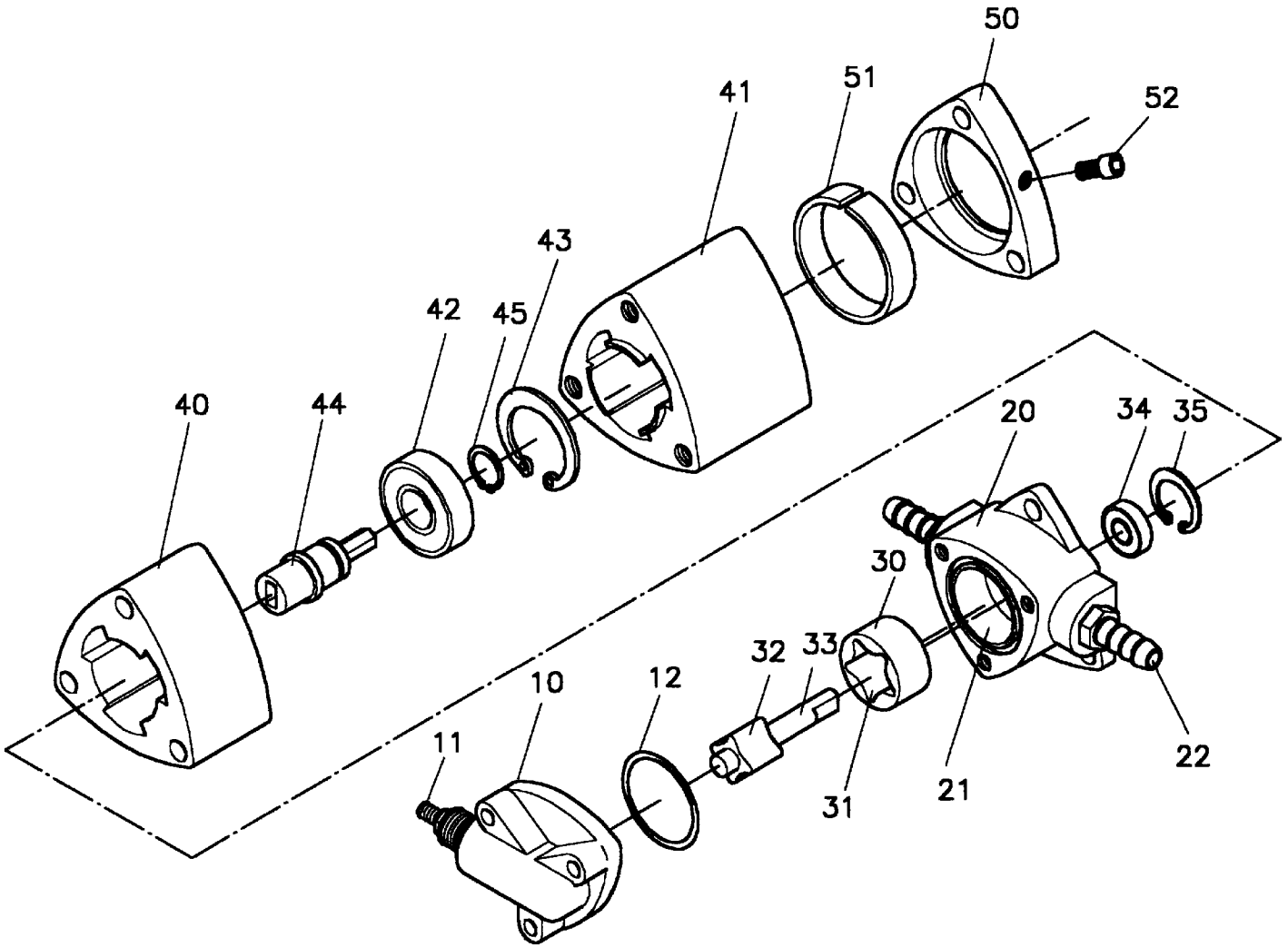
FIG. 1 is an exploded perspective view of a power transfer pump according to this invention.

Referring to FIG. 1, an exploded perspective view of a power transfer pump includes a top body 10 with several guide holes or ports 11 that are unrelated to the invention. The top body 10 is sealed with a sealing ring 12 to one end of a main body 20 comprising two ports 22 and a cylindrical chamber 21. Rotatively fitted in the cylindrical chamber 21 is an outer rotor 30 having a star-shaped expansion/compression chamber 31 meshed with a cross-shaped inner rotor 32 fixed on a shaft 33 and in communication with a respective port 22. A first bearing 34 and a first internal retaining ring 35 rotatively secure the shaft 33 within the main body 20. Another end of the main body 20 attaches to one end of a supporting base 40, 41 fitted with a connecting head 44 by a second bearing 42 and a second internal retaining ring 45. The connecting head 44 rotatively attaches to the shaft 33 secured by a third fixing ring 43 located at the end of the second bearing 42. Another end of the supporting body 40, 41 mounts onto a mounting body 50 having a flexible ring 51 fitted inside and a screwable bolt 52 pressing against the flexible ring 51.

Referring to FIGS. 2–5, a drive motor chamber 51a is formed from the connecting head 44 disposed within the supporting base 40, 41 to the mounting body 50 to enable mounting of a power source 60. The power source 60 mounts in the drive motor chamber with the flexible ring 51 encircling a positioning ring 63 located on the power source 60 with the bolt 52 rotating to clamp the positioning ring 63. In the clamped position, a connector 61 of the power source 60 engages the connecting head 44 to transmit power to the inner rotor 32 which in turn moves the outer rotor 30. The right or left direction of the power source can be adjusted by a knob 62 located on the power source 60.

Figure 2:
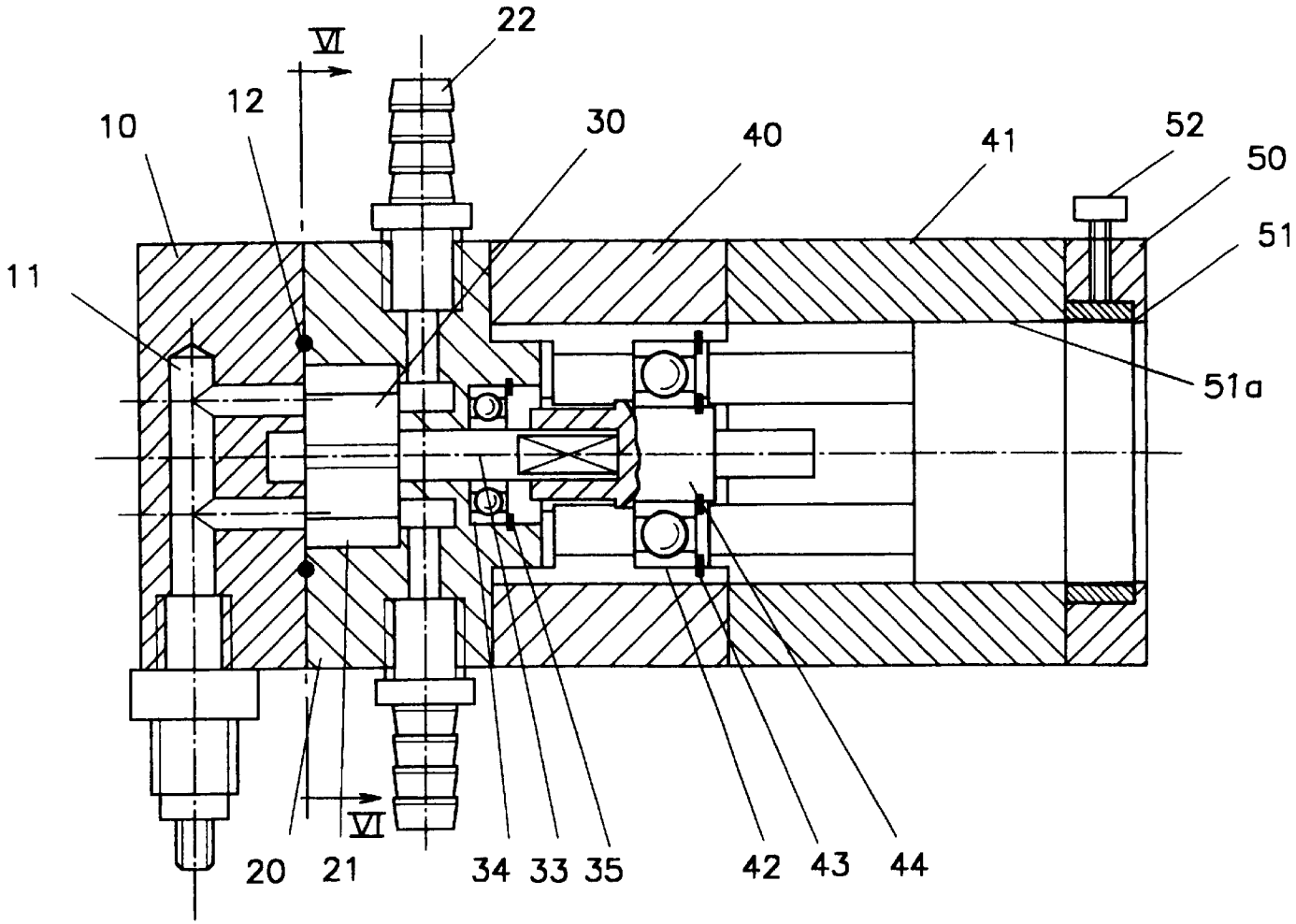
FIG. 2 is a sectional view of the assembled power transfer pump.
Figure 3:
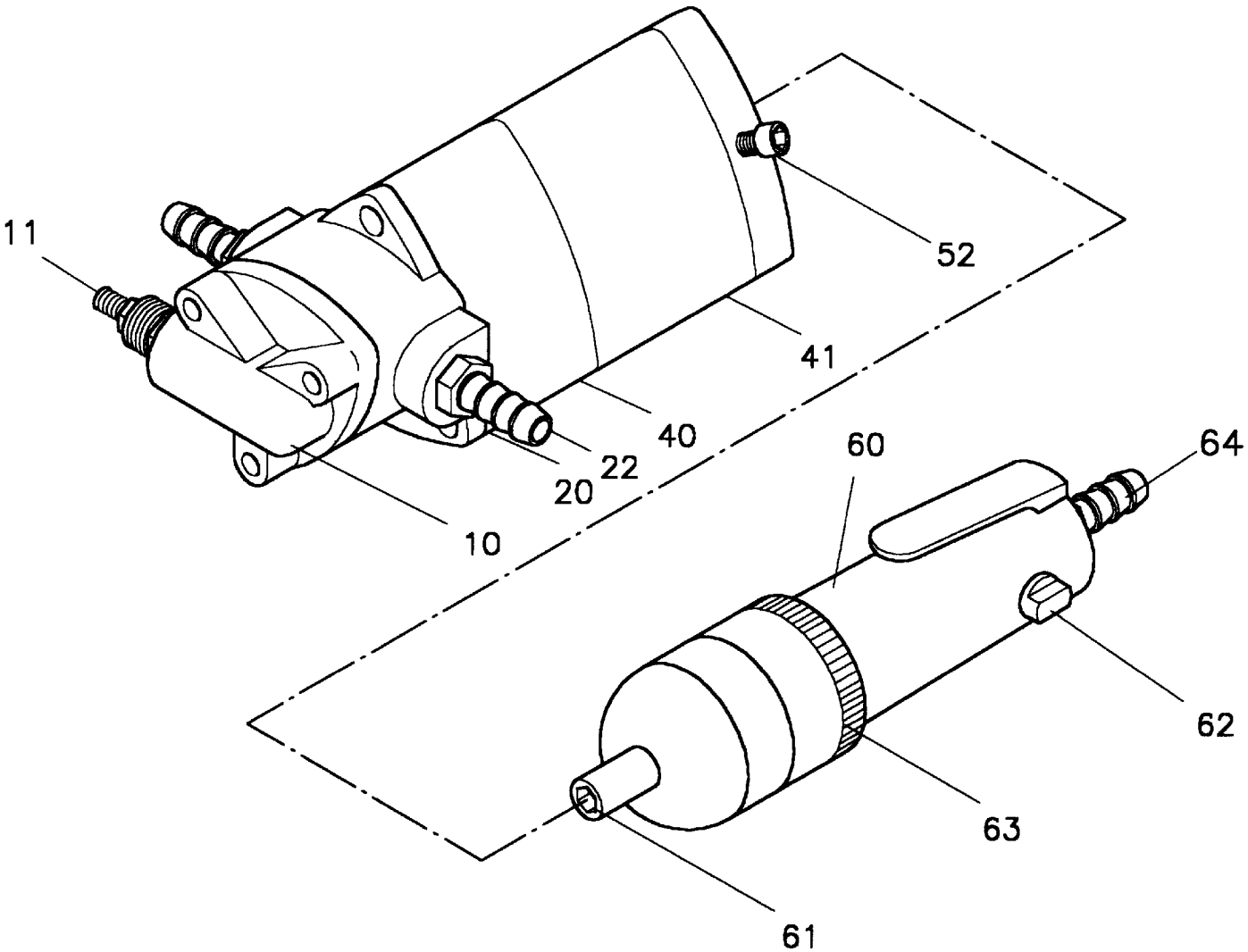
FIG. 3 is a schematic view of the pump and a power source.
Figure 4:
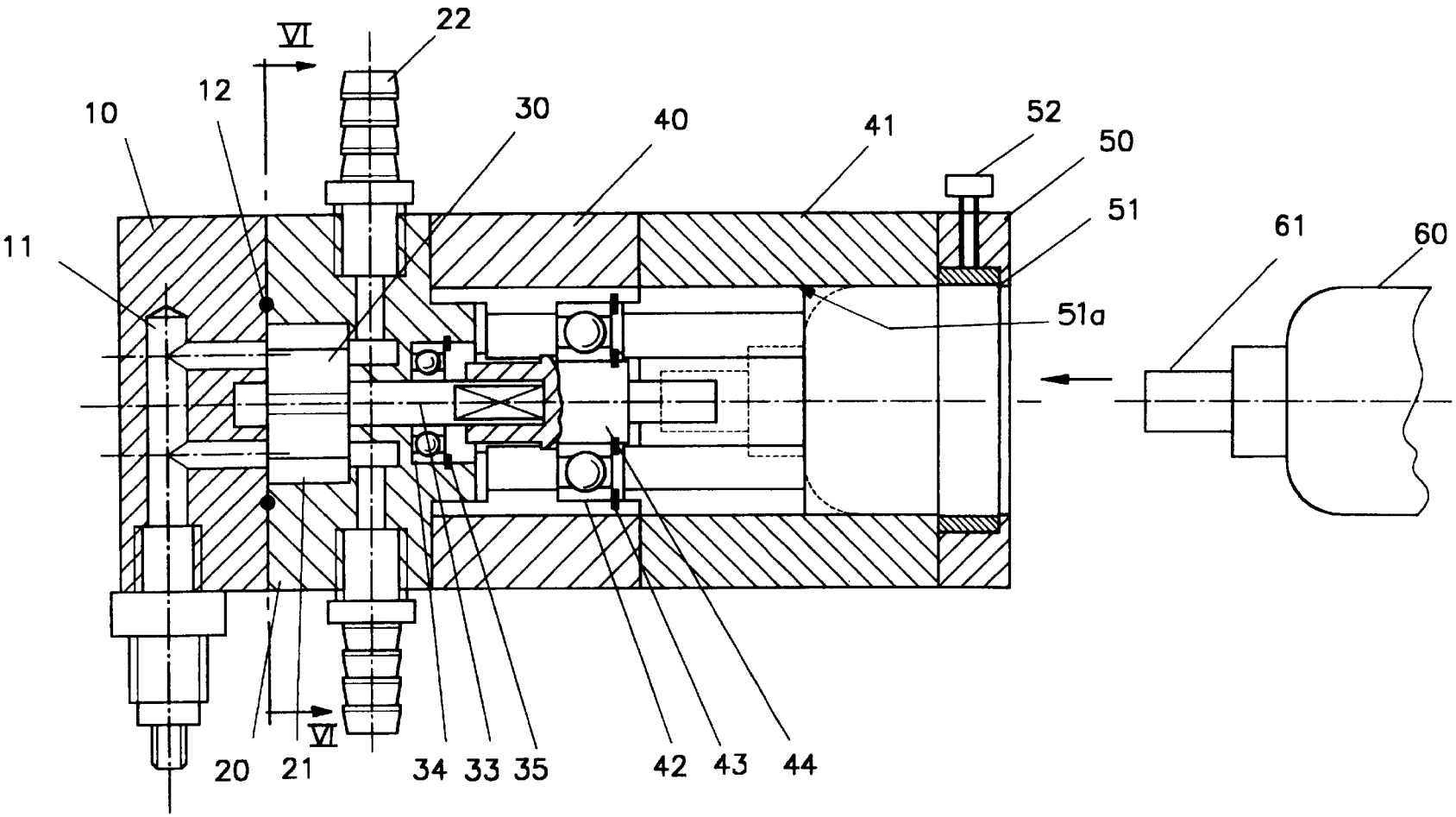
FIG. 4 is a sectional view of the pump and showing its relationship with a power source.
Figure 5:
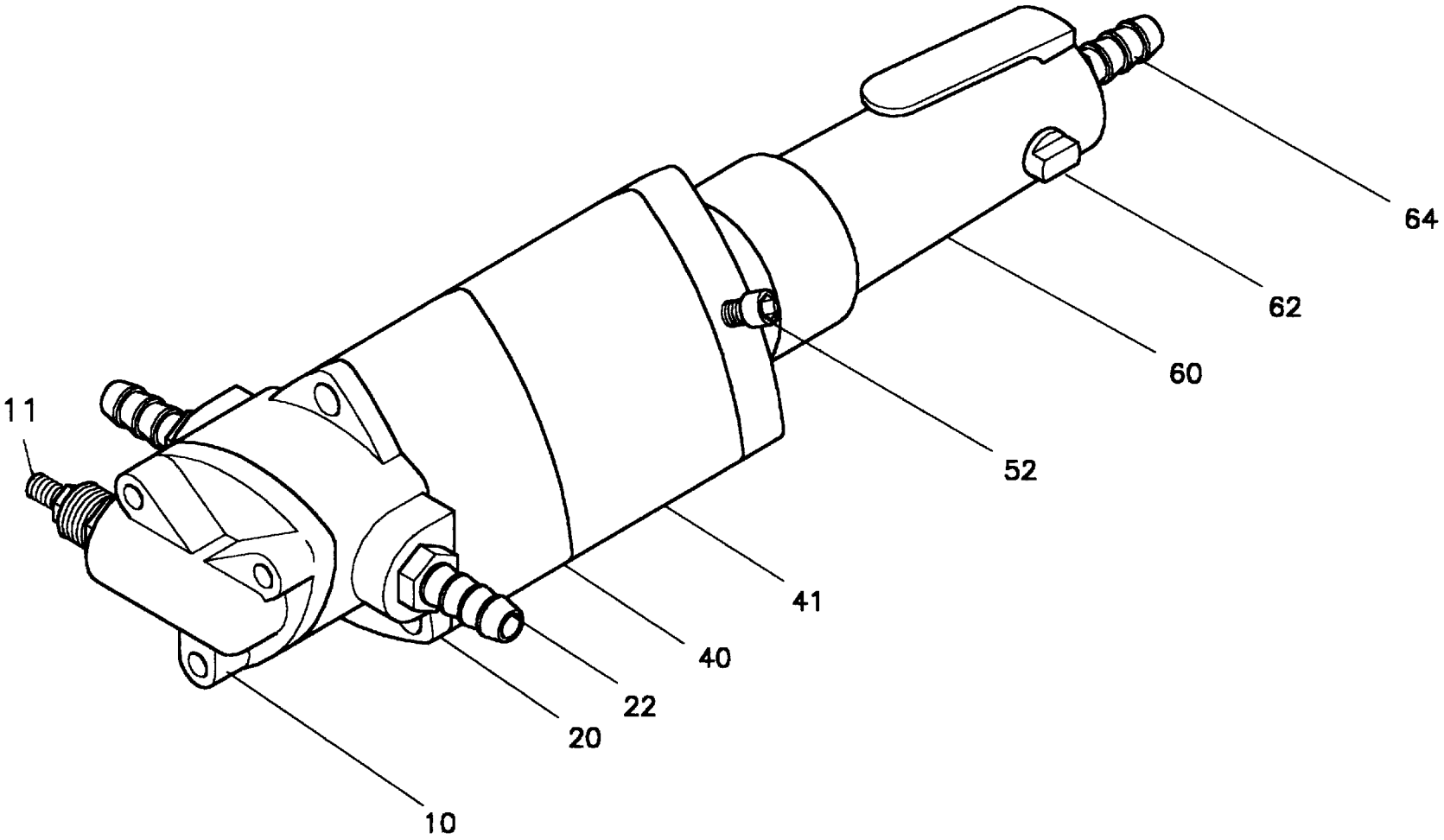
FIG. 5 is a perspective view of an assembled pump and power source.
Figure 6:
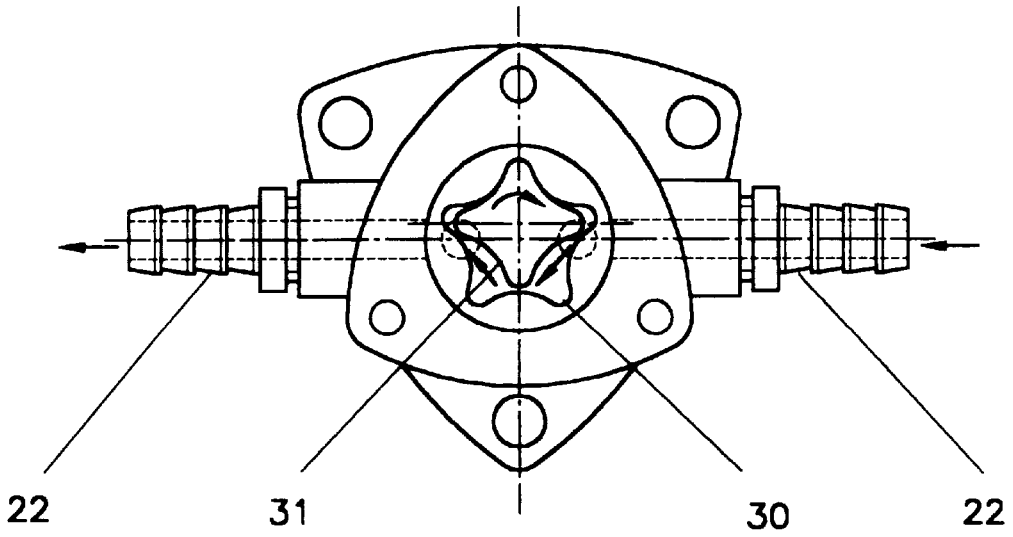
FIG. 6 is a cross-sectional taken along line VI—VI of FIG. 2.
Figure 7:
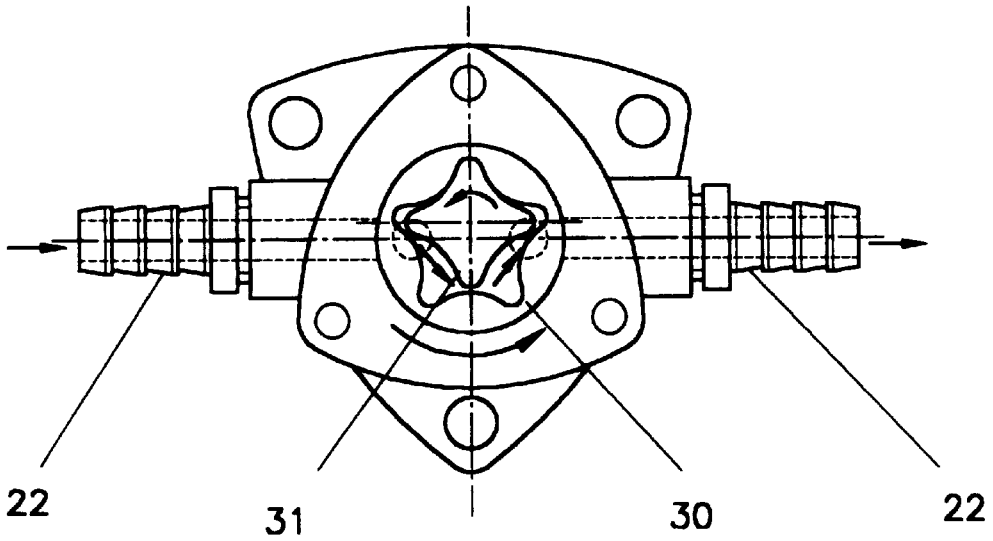
FIG. 7 is a further cross-sectional taken along line VI—VI of FIG. 2.

A cross-sectional taken along line VI—VI of FIG. 2 illustrates in FIGS. 6 and 7 the rotation of the inner rotor 31 and the outer rotor 30 at left and right rotation respectively.

Figure 8:
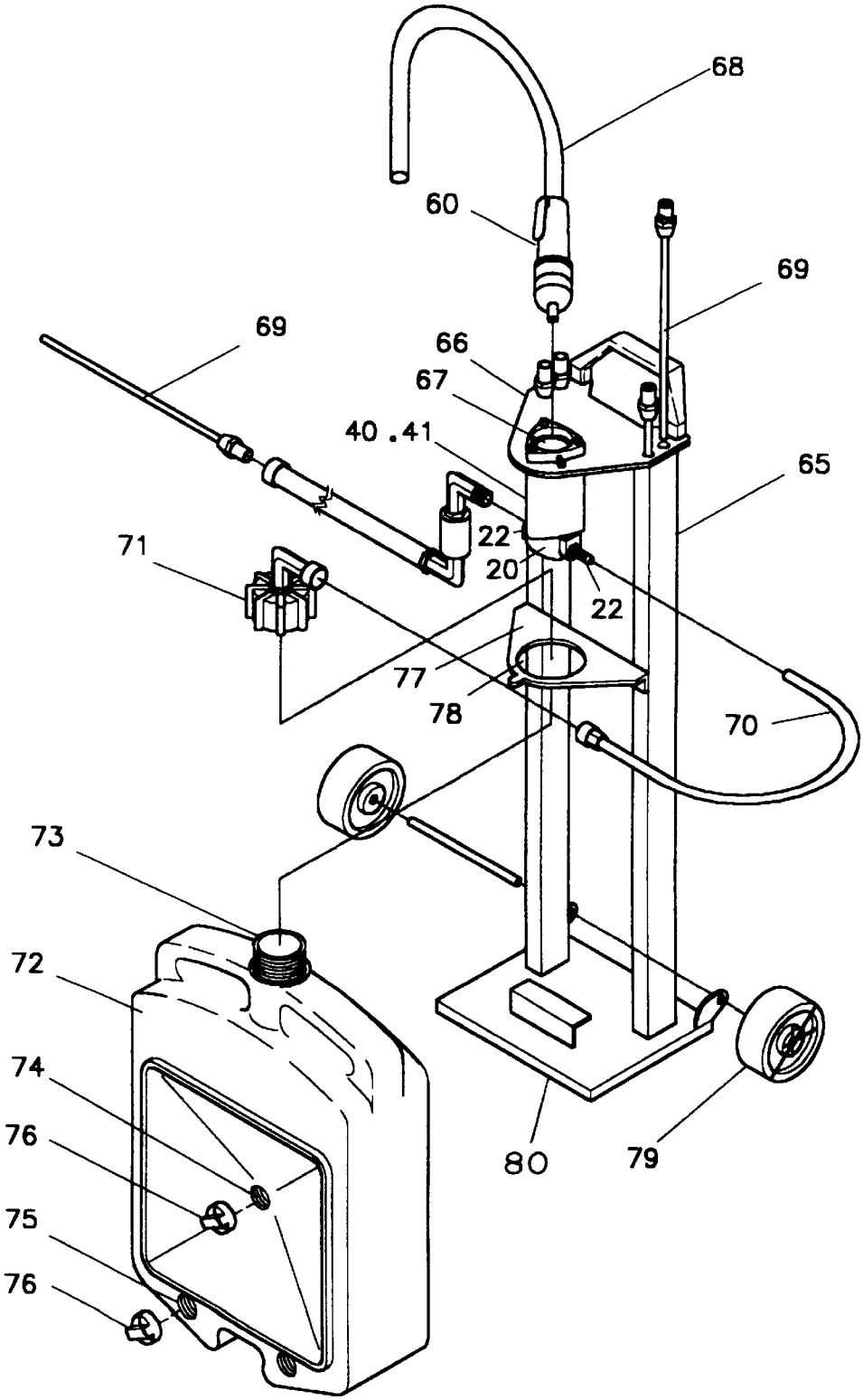
FIG. 8 is an exploded perspective view of the present invention comprising part of an oil removal station.
Figure 9:
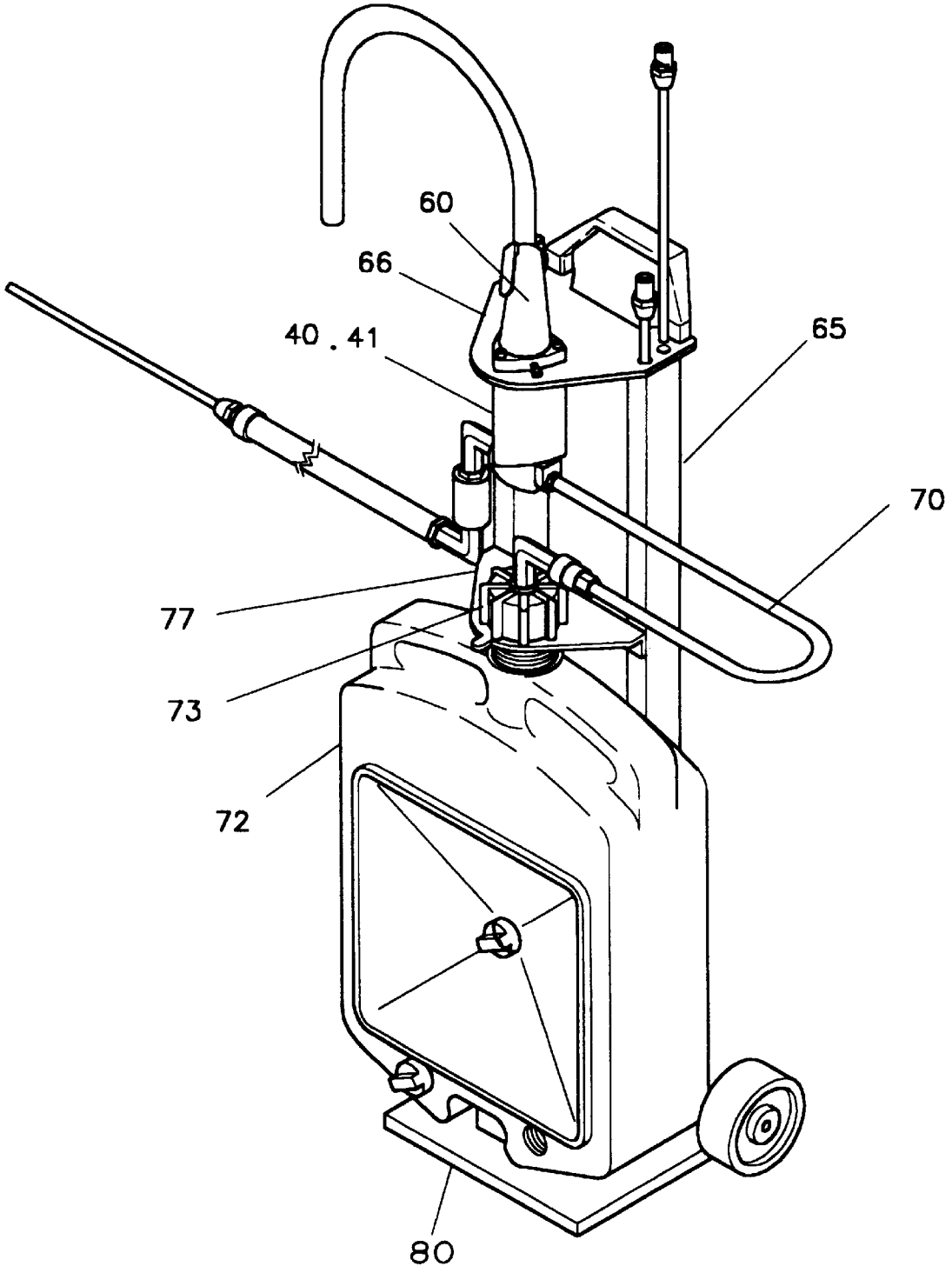
FIG. 9 is an assembly perspective view of the present invention comprising part of an oil removal station.

Referring to FIGS. 8 and 9, the present invention is integrated into an oil removal station. The power transfer pump with a power device 60 mounted therewithin inserts into a slot 67 on a top table 66 attached on a station frame 65. An air supply pipe 68 attaches to a connector 64 of the power source 60 while an oil inlet pipe 69 and an oil outlet pipe 70 connect to one and another of ports 22 respectively. The oil outlet pipe 70 also connects to a tank cap 71 that attaches to a tank outlet 73 of a tank 72. The tank 72 mounts to the station frame 65 by inserting the tank outlet 73 through a round slot 78 of a lower table 77 of the station frame 65 and securely resting on a base 80 of the station frame.

The station frame 65 includes support on the top table 66 for several different-sized oil pipes 69 and inserts on the base 80 for movable wheels 79. The tank 72 includes a plug 76 for an oil inlet 74 that can be removed to permit oil to drip directly into the oil inlet 74 if the power transfer pump is inoperable.

Figure 10:
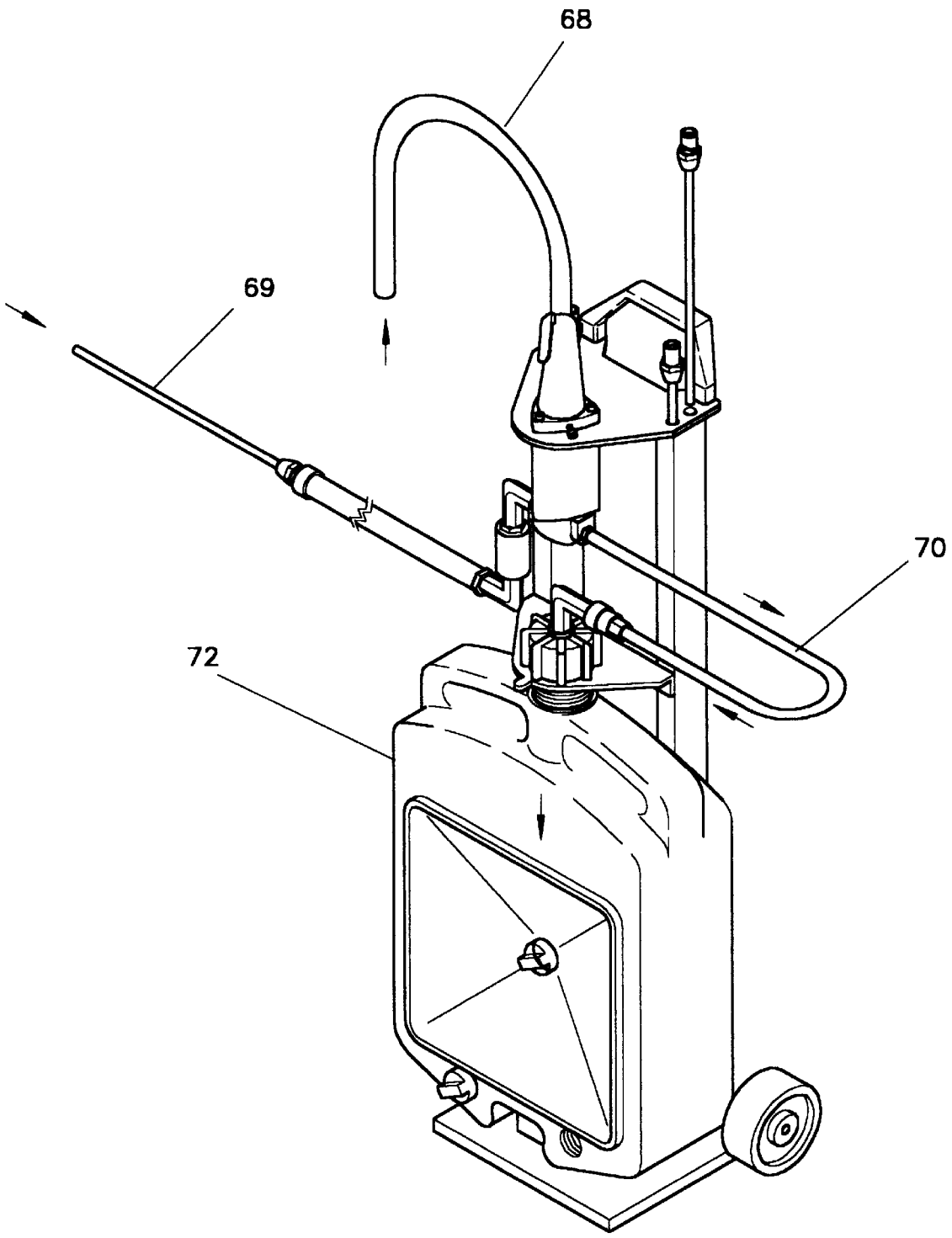
FIG. 10 is a schematic view of the present invention when changing waste oil.

Referring to FIG. 10, the oil inlet pipe 69 attaches to an oil outlet of an engine (not shown). An air supply pipe 68 joins the power source 60 from an air compressor so as to activate the rotary assembly to create an oil sucking and oil discharging effect whereby the waste oil pumps through the oil inlet pipe 69 and out of the oil outlet pipe 70, feeding waste oil to the oil tank 72.

I claim:

1. A power transfer pump comprising:

a main body comprising two ports and a cylindrical chamber wherein a rotary assembly is located;

said rotary assembly comprising a cross shaped inner rotor with a connecting shaft disposed within an outer rotor having a star shaped expansion/compression chamber;

said ports in communication with a respective expansion and compression chamber;

one end of said main body and a top body being sealed together with a sealing ring at one end of the top body;

another end of said main body and one end of a supporting body being attached together, said supporting base being fitted with a connecting head joining said shaft;

another end of said supporting body being attached to a mounting body having a flexible ring disposed within said mounting body;

a bolt mounted onto said mounting body and operably connected to said flexible ring so as to adjust the size of the ring radially upon rotation of the bolt; and a power source clamped by said flexible ring to interface with said connecting head.

2. The power transfer pump of claim 1, wherein said power transfer pump is integrated with an oil removal station comprising:

a station frame with a top table, a lower table and a base, said power transfer pump being secured in a slot of said top table;

an inlet pipe attached to one of said ports;

an outlet pipe attached to another of said ports;

said outlet site in communication with a tank comprises an oil inlet with a plug centrally located on a side of said tank, at least one air drain hole with another plug located on said side of said tank, and an outlet having a cap;

said tank outlet connected to said lower table;

the base of said station frame supporting said tank;

said outlet pipe connected to said cap;

a support for several additional inlet pipes provided by said top table; and wheels secured to the base.

* * * * *